United States Patent [19]

McClaren

[11] 4,270,280

[45] Jun. 2, 1981

[54] RICE DRYING MACHINE

[76] Inventor: Jay L. McClaren, Dassel, Minn. 55325

[21] Appl. No.: 14,928

[22] Filed: Feb. 26, 1979

[51] Int. Cl.[3] ..... F26B 3/06

[52] U.S. Cl. ..... 34/30; 34/31; 34/46; 34/48

[58] Field of Search ..... 34/26, 28, 30, 31, 32, 34/33, 46, 48, 50, 168, 169, 174

[56] References Cited

U.S. PATENT DOCUMENTS

| | | | |
|---|---|---|---|
| 3,053,522 | 9/1962 | Applegate | 34/174 |
| 3,092,472 | 6/1963 | Figley | 34/174 |
| 3,148,955 | 9/1964 | Nichols | 34/50 |
| 3,209,465 | 10/1965 | Arena | 34/50 |
| 3,406,463 | 10/1968 | Andersen | 34/174 |
| 3,600,820 | 8/1971 | Klein | 34/174 |

FOREIGN PATENT DOCUMENTS

| | | | |
|---|---|---|---|
| 357676 | 11/1961 | Sweden | 34/50 |
| 483659 | 12/1975 | U.S.S.R. | 34/50 |

*Primary Examiner*—Larry I. Schwartz
*Attorney, Agent, or Firm*—H. Dale Palmatier

[57] ABSTRACT

Rice drying apparatus, a dryer directing heated air through the rice being dried, a control maintaining predetermined differential between the wet bulb and dry bulb temperature of the air used in drying, a modulating apparatus controlling the heat of the burner, the method of establishing a predetermined differential between wet bulb and dry bulb temperature of the air used in drying rice and the like, and subsequently increasing the differential as drying proceeds.

19 Claims, 11 Drawing Figures

RICE DRYING MACHINE

This invention relates to method and apparatus for drying rice and the like.

BACKGROUND OF THE INVENTION

Rice, as a grain, presents some very difficult problems, unlike most other grains, as the rice is processed from the time it is in the field and reaching maturity, to the time it is ready for wholesale or retail distribution and consumption.

A principal reason for processing problems, unique to rice, is the particular nature of the rice kernels and particularly the starchy endosperm of the kernel. The endosperm has a flinty nature which is another way of saying that the kernel may be considered to be brittle and rather easily fractured. The rice kernels are quite hygroscopic so as to readily absorb moisture, and the rice kernels also give up their moisture relatively easily. The rice kernels have a propensity to shatter or fissure quite easily, and when this occurs, the individual kernels break down and result in the formation of a powder or flour. In any event, fissured or shattered kernels have a very low value in the marketplace as does the resulting powder or flour, as compared to the whole kernels.

This fissuring or shattering of the rice kernels occurs principally during rapid changes in moisture content of such rice kernels. The rapid absorbing of moisture and the rapid drying of the kernels will both tend to cause fissuring. When mature rice stands in the field just prior to harvesting, if climatic conditions induce rapid drying, fissuring may very likely occur to a large percentage of the kernels; and in a somewhat similar way, if such standing rice is relatively dry and is suddenly subjected to high moisture conditions, a significant proportion of the kernels of rice may fissure due to the rapid absorption of moisture. Fissuring is also likely to occur during artificial drying after harvest.

An excellent discussion of drying rice may be found in "Rice Chemistry and Technology", edited by D. F. Houston, published by American Association of Cereal Chemists, Inc., St. Paul, Minn., Copyright 1972, at pp. 140–165.

As a practical matter, substantially all drying of rice that is done in the United States is done by commercial dryers in fixed installations located adjacent substantial storage capacity provided by grain elevators. Such drying is in continuous flow heated air dryers by a multi-pass method which essentially means that rice is run through a dryer wherein the rice kernels pass downwardly through columns and simultaneously hot air is blown transversely through the columns of moving rice. After the rice has passed through the dryer, the rice is returned to storage bins for tempering, and after a tempering of four to twenty-four hours, the rice is cycled through the dryer again. Each time the rice is passed through the dryer, the drying process may take fifteen to thirty minutes and may remove two to three percentage points of moisture. It can readily be understood that this method of drying rice is rather cumbersome and requires a substantial amount of handling of the rice between the dryer and the storage facility.

Some commercial drying of rice is in a column type dryer, and other rice dryers require the falling rice to pass downwardly over a series of baffles to simultaneously mix the moving rice as it is dried.

In any event, this multi-pass method of drying rice is substantially more cumbersome than the methods used in drying other grain. It has been experienced that because of the extreme abrasive nature of rice as it is handled in a multi-pass drying operation, the drying equipment is extremely subject to wear and the major parts of the machinery which are in constant engagement with the continually moving rice must be frequently replaced or rebuilt.

Because of the peculiar nature of rice and the propensity of it to shatter or fissure, there has been practically no drying of rice accomplished by farmers in the United States on their own farms. Of course, in other countries, individual farmers may dry their rice by laying the rice out on concrete slabs in the sun, and to some extent, rice may be dried in shallow beds with air being forced upwardly through it. Of course, such techniques do not accommodate large quantities of rice.

The fissuring problem of rice has been and continues to be a major obstacle to efficient and thorough drying of rice for maximum market value.

Techniques and apparatus which have been successfully used in drying other grains such as corn, oats, wheat, etc., has not been successful in drying rice. None of these other grains is subject to fissuring and loss of market value as is rice. The typical technique in drying corn, which is not successful in drying rice, is to simply drive as much hot air at as high a temperature as can be attained in order to dry the corn as rapidly as possible. If this technique used for corn were to be tried with rice, the whole batch of rice would be completely fissured and almost valueless.

One other grain, soybeans, is known to present problems in drying which are of the same general nature as presented by rice, especially when the soybeans are being processed for use as seed.

SUMMARY OF THE INVENTION

It is an object of the invention to provide a solution to the drying problems encountered in drying rice as heretofore pointed out.

It is another object of the invention to provide improved methods and apparatus useful in drying rice so that the rice can be dried without very substantial storage facilities being immediately available as has been previously required.

It has been determined that rice may be successfully dried without fissuring by passing air through a column or bed of rice, which air has only a relatively low temperature and then, after drying has progressed, the temperature may be raised in several stages to a final relatively high temperature.

In order to determine the temperature of the air to be used for drying the rice, reference is made to the wet bulb temperature of the air which is used for the drying. The wet bulb temperature of air remains the same regardless of the actual dry bulb temperature of the air, and accordingly, the wet bulb temperature may be sensed either before or after the air has been heated. According to the present invention, when the heating of the air is automatically controlled, the wet bulb temperature is sensed at approximately the same location as the dry bulb temperature of the heated air is sensed. The wet bulb temperature of air is an indication of the actual moisture content of the air. At various dry bulb temperatures, air has varying capacity to absorb more moisture. The differential between the wet bulb and dry bulb temperatures is apparently related to the capability of the air to absorb additional moisture as from rice kernels in a drying operation. It has been found that across a wide spectrum of both wet bulb and dry bulb temperatures, there is a substantially constant differential between wet and dry bulb temperatures as to maintain a predetermined drying rate of the grain. For instance, in order to maintain approximately 14 percent moisture in rice, over a range of approximately 80° F. to 134° F. wet bulb temperature, approximately a 6° differential in the dry bulb temperature of the drying air will maintain the equilibrium 14 percent moisture in the rice. In other words, at whatever wet bulb temperature is sensed in the air being circulated through the rice in the range of 80° F. to 134° F., an equilibrium condition in the rice is maintained so that the rice has a constant 14 percent moisture, if the air circulated through the rice is maintained at a dry bulb temperature of approximately 6° F. above the wet bulb temperature; and accordingly, if the wet bulb temperatures vary from 80° to 134° F., the dry bulb temperatures must vary from approximately 86° F. to 140° F.

For other equilibrium conditions to be maintained, such as 16 percent moisture, a different differential between dry bulb and wet bulb temperatures in the air must be maintained. The higher the differential of dry and wet bulb air temperature the lower the percentage moisture condition will be in the rice; and the lower the differential, the higher will be the percentage moisture in the rice. A number of wet and dry bulb temperatures for maintaining equilibrium at 14 percent moisture in the rice are indicated in the following table:

| Dry Bulb (°F.) | Wet Bulb (°F.) | Differential (°F.) |
|---|---|---|
| 65 | 60. | 5. |
| 75 | 69.5 | 5.5 |
| 85 | 78.75 | 6.25 |
| 90 | 83.6 | 6.4 |
| 100 | 94. | 6. |
| 115 | 109. | 6. |
| 125 | 119. | 6. |
| 140 | 134. | 6. |

Actual drying of the rice is accomplished by increasing the differential between wet bulb and dry bulb temperatures of the air used for drying. For instance, in a drying operation, when the goal is to attain such 14 percent moisture in the rice, wet bulb temperature will be continuously sensed, and sufficient heat is added to the atmospheric air in order to increase dry bulb temperature and increase the differential well beyond that needed to maintain equilibrium condition, for the initial drying stage. This produces a significant drying rate of several points per hour, but the rate of drying is not so great as to cause any fissuring of the rice.

After the drying has been continuing for a time at certain differential between dry bulb and wet bulb temperatures, the rate of drying will decrease below optimum or desired rate. When it has been determined that the rate of drying has dropped below the desired rate, the differential between wet bulb and dry bulb temperatures of the drying air may be increased again, and the rate of drying will be increased to the desired level. During this second stage of heating, and drying, there continues to be no fissuring of the rice due to the drying operation.

When the rate of drying again falls off below optimum rate, a still larger differential between the dry bulb and wet bulb temperatures of the air is established, and the rate of drying is reestablished and maintained at a desired level.

In maintaining the desired rate of drying by progressively establishing various differentials between wet bulb and dry bulb temperatures as described, the column of rice may be allowed to remain stationary, and in this situation, the heat source is so operated as to vary the rate of drying by varying the heat applied to the drying air. The dry bulb temperature of the air applied to the column will be progressively increased.

On the alternative, a moving column of rice may be utilized with multiple heat sources along which the column successively passes. Initially, the moving column will pass along a first heat source establishing a first differential between wet bulb and dry bulb temperatures. If a particular segment of the column is subjected to the first heat source, the rate of drying in that segment will gradually fall off. As the column passes along a second heat source, the differential between wet bulb and dry bulb temperatures is increased, and the rate of drying in that segment will sharply rise and then gradually fall off again. Then the differential is again increased as the column of rice passes by a third heat source, to again increase the rate of drying in the moving column.

In a typical situation wherein there is a significant amount of moisture to be removed from the rice, such as in the situation where rice is harvested at 22 percent moisture and is to be dried to an equilibrium condition of 12 percent moisture, the drying is accomplished through three or more stages as described wherein the differential between wet bulb and dry bulb temperatures is not so great as to cause fissuring. On the other hand, in the instance wherein only a minimum of drying is to be effected, the use of three stages as described may be unnecessary. For instance, it may be necessary to only establish one drying stage wherein a prefixed differential between wet bulb and dry bulb is established and then is maintained throughout the drying process.

Although drying is usually accomplished in a dryer which confines the rice in upright columns, the use of such columns is not essential to the drying process. Drying may just as well be accomplished with the rice laying in a bed on a perforate plate or screen through which drying air may be passed upwardly and through the rice. In so drying the rice in a bed, it is important that the bed of rice not be excessively deep, but may have a depth comparable to the thickness of the upright columns in which rice is dried in other types of machines. Again, regardless of whether the rice is in an upright column or lying in a bed, a certain differential is maintained between the dry bulb and wet bulb temperatures of the drying air so as to accomplish drying without fissuring. When the drying rate falls off, it may be necessary to increase the differential between wet bulb and dry bulb temperatures, primarily by increasing the dry bulb temperature of the air as a result of adding heat from a burner.

The method set forth may also be accomplished in coordination with movement of the rice in a bed substantially horizontally as by a belt conveyor or a conveyor utilizing a shaker table. The belt conveyor may have a perforate conveying belt formed of woven fabric or screen so that air may pass upwardly through it. As the granular material to be dried is carried on the perforate belt conveyor, the granular material is first moved over a first plenum chamber which moves drying air upwardly through the bed of granular material so that a predetermined differential between dry bulb and wet bulb temperatures is maintained. The rate of movement of the granular material on the perforate conveyor is similar to the rate of downward movement of the column of granular material moving downwardly through a vertical column as previously described. After the rate of drying has fallen off in the moving bed of granular material, the bed is then moved over a second plenum chamber wherein the differential between wet bulb and dry bulb temperatures is increased so as to again reestablish the desired rate of drying. Again, after the rate of drying has fallen off as the bed of granular material moves over the second plenum, the bed will subsequently move over a third plenum wherein the differential between dry bulb and wet bulb temperatures is again increased to again increase the rate of drying in the moving bed of granular material. Subsequently the bed of granular material will pass by and out of the influence of the air in the final plenum chamber and will be discharged from the perforate belt conveyor.

A very similar drying may be accomplished with a shaker table type conveyor wherein heated air is moved upwardly through the bed of granular material carried on the screen table. In such a shaker type conveyor, the bed of granular material may be subjected to air in which a single differential between dry bulb and wet bulb temperatures is maintained, or as suggested previously, the differential may be progressively increased as the bed of granular material moves along the conveyor, which in this form may be a shaker table. In the case of drying as the granular material moves along a shaker table, the air provides a dual function, that of drying and of providing some lifting function or buoyancy in the grain as it travels over the oscillating screen table.

While primary attention heretofore has been given to rice, the concepts and techniques set forth herein are not necessarily limited to use with rice. There are other grains and granular materials that are difficult to handle as is rice. One other natural product is soybeans, especially sobyeans being processed for use as seed. While the tendency in soybeans to fissure is not as critical as in rice, when soybeans are being processed for seed, they must be carefully handled during drying so as to minimize the possibility of damage due to fissuring. The method and techniques set forth herein are also applicable to drying other granular materials which tend to be hygroscopic in nature. This may include manufactured products and materials as well as natural products.

This method of sensing the wet bulb temperature of the drying air and applying sufficient heating to the air is to produce a predetermined differential between the wet bulb temperature and the dry bulb temperature of the drying air, and in this manner controlling the drying rate, is an important aspect of the present invention, and is considered to be a distinctly different and novel method for drying rice and similar materials in a single operation from harvesting moisture conditions down to 12 to 14 percent moisture which is commonly accepted as suitable storage conditions.

It is an object of the invention to create an automatic control device to utilize wet bulb temperature as a base or reference point and then establish sufficient heating as to establish a dry bulb temperature having a predetermined differential as relates to the wet bulb temperature.

In one embodiment an expansion tube is draped with a continuously wet wick, and will lengthen and shorten according to wet bulb temperature. A substantially parallel dry expansion rod has one end affixed to a corresponding end of the wet bulb tube and has its other end confronting a control such as a microswitch for operating the microswitch in response to lengthening and shortening due to the change of dry bulb temperature. The rod may be shortened or lengthened to vary the spacing between the end of the rod and the microswitch in order to vary the differential attained and maintained between wet bulb and dry bulb temperature.

Another object of the invention is to create a stationary batch dryer with thermostatic controls to vary the temperature of the heating air in accordance with a prefixed differential between wet bulb and dry bulb temperatures to establish the initial low dry bulb temperature for accomplishing the initial significant drying of the rice, and then later raising the differential by raising the second stage dry bulb temperature to accomplish further drying and finally, in a third stage, raising the differential again to quickly bring the rice down to desired moisture levels.

In summary, the present invention relates to three different phases, the method of drying by establishing the dry bulb temperatures of the dry air in predetermined relation to the wet bulb temperature of the air, a thermostatic control for indicating a differential between wet bulb and dry bulb temperature; and a dryer wherein wet bulb temperature is used as the base of reference point for regulating the heating of the air used for drying and bringing the drying air up to predetermined dry bulb temperatures, all without regard to the actual ambient temperature at the exterior of the dryer.

DETAILED SPECIFICATION

Figure 1:
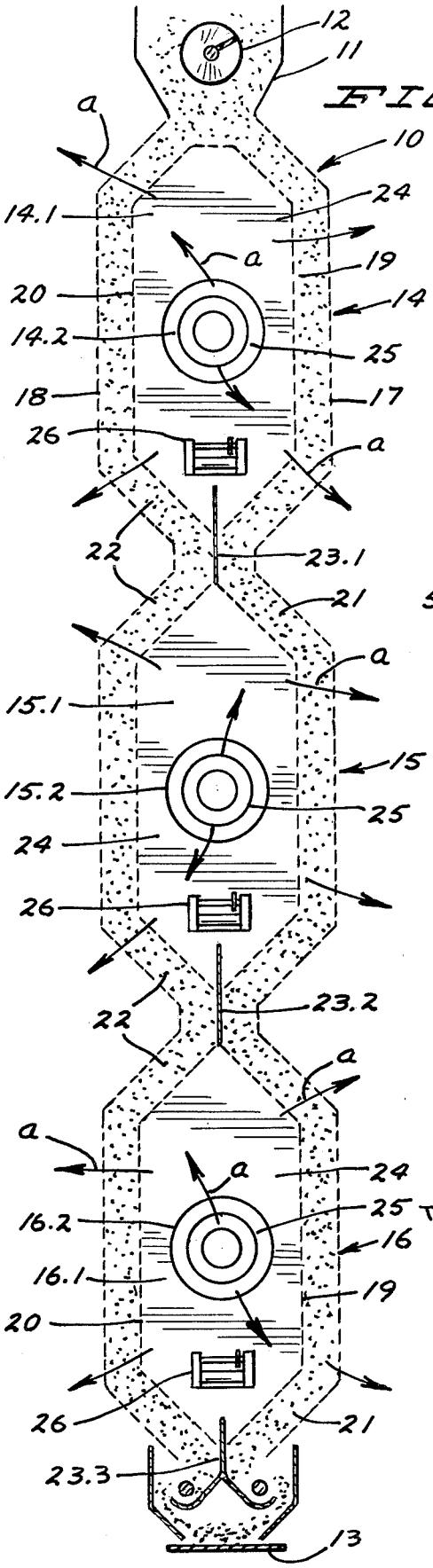
FIG. 1 is a somewhat diagrammatic section view taken through a dryer incorporating the present invention.

A dryer which is useful in carrying out the method of the present invention and incorporating the apparatus of the present invention is illustrated in FIG. 1, in substantially diagrammatic form. The dryer is indicated in general by numeral 10 and has a hopper inlet structure 11 at its top end to receive rice from a bin or from a suitable conveying mechanism. The hopper structure 11 is elongate so as to extend along the entire length of the dryer 10 and in the form illustrated, a screw conveyor 12 is mounted in the receiving hopper 11 to spread the rice all along the length of the dryer.

At the bottom of the dryer, the rice is collected on a belt conveyor 13 to be delivered from the dryer for further storage or processing.

Between the inlet hopper 11 and the outlet conveyor 13, the dryer 10 has a number of drying stages, and in this embodiment has three drying stages indicated by the numerals 14, 15 and 16.

The dryer has outer perforate walls 17 and 18 and inner perforate walls 19 and 20 defining columnar spaces 21 and 22 therebetween to carry rice in a column downwardly through these spaces from the inlet hopper 11 to the outlet conveyor 13. It will be recognized that the columnar spaces 21 and 22 converge downwardly toward each other at the lower portion of each of the stages 14, 15 and 16, and solid walls 23.1, 23.2 and 23.3 continue to separate the columnar spaces 21 and 22 at the points of convergence thereof. The dryer 10 has imperforate end walls 24 at both ends to prevent escape of air therethrough.

At each of these stages 14, 15 and 16, the inner perforate walls 19 and 20 define separate plenums 14.1, 15.1 and 16.1 which are substantially isolated from each other.

At the plenums 14.1, 15.1 and 16.1, the end wall 24 has openings 14.2, 15.2, and 16.2 through which is received heated air under pressure so that the heated air is forced outwardly through the columns of rice in the columnar spaces 21 and 22.

Heating and pressurizing of the air is accomplished by a plurality of combined burner and fan units 25, each disposed in a respective opening 14.2, 15.2 and 16.2. Preferably these burner and fan units 25 burn propane for fuel so that they may be modulated to vary the amount of heat added to the air. Otherwise, the heat may be supplied to the air by any suitable source of heat including electric resistance element.

Flow of air from the combined burner and fan units 25 is indicated by the arrows a. It will be recognized that air from each unit passes through the column of rice at a particular stage, and while there may be some advantage under certain circumstances to recirculate air, it is desired to carefully control the temperature of the air at each stage of drying, and accordingly essentially no intercommunication of air flow from one plenum to another occurs.

In each of the plenums 14.1, 15.1 and 16.1, a temperature-sensing and control unit 26 is provided for regulating the burner or source of heat. All of the temperature-sensing and control units 26 are substantially identical except for possible minor adjustments so as to produce different temperatures in the several plenums.

Figure 4:
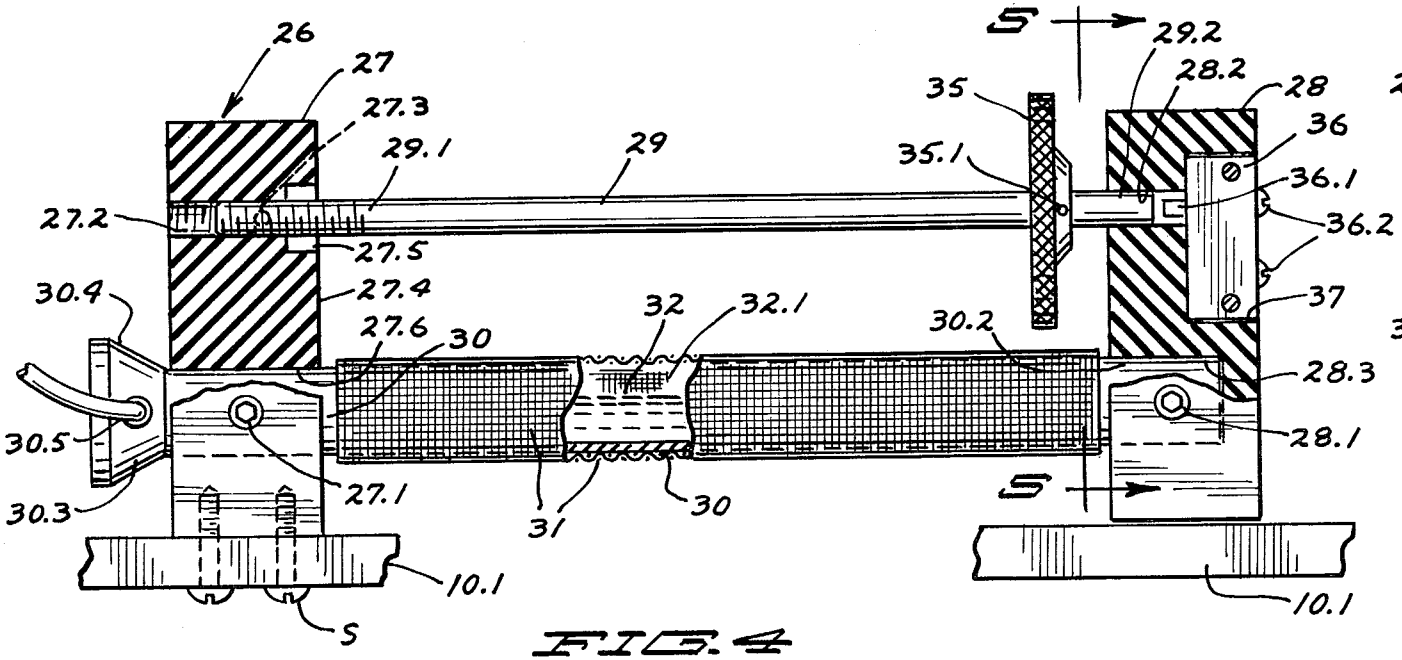
FIG. 4 is an elevation view of the temperature sensing control unit, and partly shown in section for clarity of detail.
Figure 5:
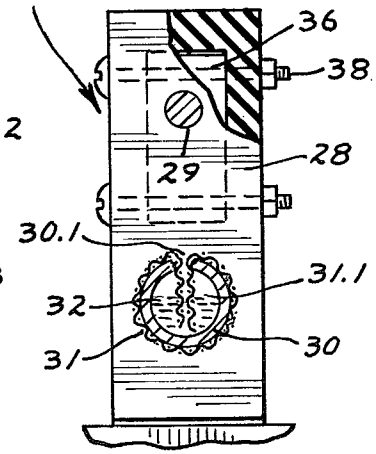
FIG. 5 is a transverse section view of the apparatus of FIG. 2 and taken approximately as indicated at 5—5 in FIG. 4.

The temperature control units 26 are illustrated in detail in FIGS. 4 and 5 and include a pair of mounting blocks 27 and 28 which are preferably constructed of nylon or other insulating material which is stable under the temperature conditions encountered in the dryer. A pair of sensing rods 29 and 30 are carried by the mounting blocks 27 and 28, and both of the rods 29 and 30 are formed of identical metallic material, preferably aluminum, so that both of the rods 29 and 30 have identical coefficients of expansion. The aluminum rods 29 and 30 will extend and retract longitudinally under different temperature conditions so as to provide an indication of the sensed temperature.

It will be recognized that the rod 29 is solid and the rod 30 is tubular. In other forms of the invention, the rods 29 and 30 might be either solid or tubular, and, as is illustrated in connection with FIGS. 7 and 8, not all of the rods which connect the blocks need to be circular in configuration. While other configurations may necessitate modifying the form of wick that is applied, it should be clear that varying shapes of rods which interconnect the end of blocks may be used.

In the form illustrated in FIGS. 4, 5, opposite ends of rod 30 are affixed to the mounting blocks 27 and 28 by means of set screws 27.1 and 28.1 in tapped apertures in the mounting blocks 27 and 28. Accordingly, the ends of rod 30 are substantially immovable with respect to the adjoining mounting blocks 27 and 28; and as the tubular rod 30 lengthens and shortens under influence of temperature, the mounting blocks 27 and 28 will be moved further apart and closer together, respectively.

The tubular rod 30 has a slot 30.1 all along its upper side. The rod 30 is embraced by a fabric wick 31 which may be formed of cotton or other similar fabric material and which extends substantially all along the length of the rod 30 between the mounting blocks 27 and 28. The wick 31 entirely encircles the metallic rod 30 and has a depending web or edge portion 31.1 which extends downwardly through the slot 30.1 and the rod 30 into a pool 32 of water within the tubular rod.

The ends of the tubular rod 30 are sealed so as to confine the pool 32 of water therein. The ends of the rod 30 may be sealed in any of a number of manners, but in the form illustrated, the end 30.2 of the tubular rod 30 is sealed by a sealing adhesive in the aperture 28.3 of the block 28.

The other end 30.3 of the tubular rod extends entirely through the mounting opening 27.6 of block 27. The terminal end 30.4 of the tubular rod 30 is pinched closed so as to be entirely sealed shut. A supply tube or pipe 30.5 is connected to the closed end 30.3 of the tubular rod 30 for the purpose of replenishing the water in pool 32. The level may be maintained by a float valve in a reservoir.

Either of the mounting blocks 27 or 28 may be affixed to the frame of the dryer, and the other of the blocks will remain detached so that one of the blocks can freely move as the rod 30 expands and contracts under influence of wet bulb temperatures. In the form shown in FIG. 4, the block 27 is affixed to the frame 10.1 as by screws S, and the block 28 is free to move along the frame in response to expansion of the rod 30.

Accordingly, the rod 30 essentially senses wet bulb temperature of the moving air adjacent the control apparatus 26, and the mounting blocks 27 and 28 move toward and away from each other in response to existing wet bulb temperature of the air in the several plenums of the dryer.

Aluminum rod 29 has a threaded end 29.1 which is threaded into a tapped aperture 27.2 in mounting block 27. Accordingly, the rod 29 may be adjustable, as to location, with respect to the mounting block 27.

During operation conditions, the rod 29 will be in fixed position with respect to the block 27 by a set screw 27.3 threaded into the mounting block 27 and bearing against the threaded end of the rod 29. The set screw 27.3 and the pin 27.1, which hold the two rods relative to the mounting block 27, are disposed at substantially equal distances from the inner surface 27.4 of the block, and the block is counterbored at 27.5, approximately to the location of the set screw 27.3 from surface 27.4 so as to permit the rod 29 to freely lengthen and shorten throughout all of its operative length.

A rod-rotating disc 35 is affixed onto rod 29 by a set screw 35.1, and has a knurled rim to facilitate turning the rod 29 and changing its effective location with respect to the mounting block 27. The end 29.2 of the aluminum rod 29 is smooth and is freely movable in a bearing aperture 28.2 of mounting block 28 so as to accommodate the longitudinal extension and shortening of rod 29 under influence of temperature.

The end of rod 29 confronts, in closely spaced relation, the control element or operating button 36.1 of a microswitch 36 mounted in a cavity 37 in mounting block 28. A pair of anchor bolts 38 retain the switch in the mounting block 28 so as to maintain the control element or switch button 36.1 in fixed position with respect to the mounting block.

The switch 36 has conductor terminals 36.2 so as to provide for connecting to the control circuitry.

As the aluminum rod 29 lengthens and shortens, the end 29.2 of the rod will engage and operate the control element 36.1 of the switch so as to render the switch closed or open. The rod 29 senses the dry bulb temperature of the air adjacent the control unit 26, and accordingly, the several rods 29 of the several control units 26 sense the dry bulb temperatures in the respective plenums of the dryer.

Figure 6:
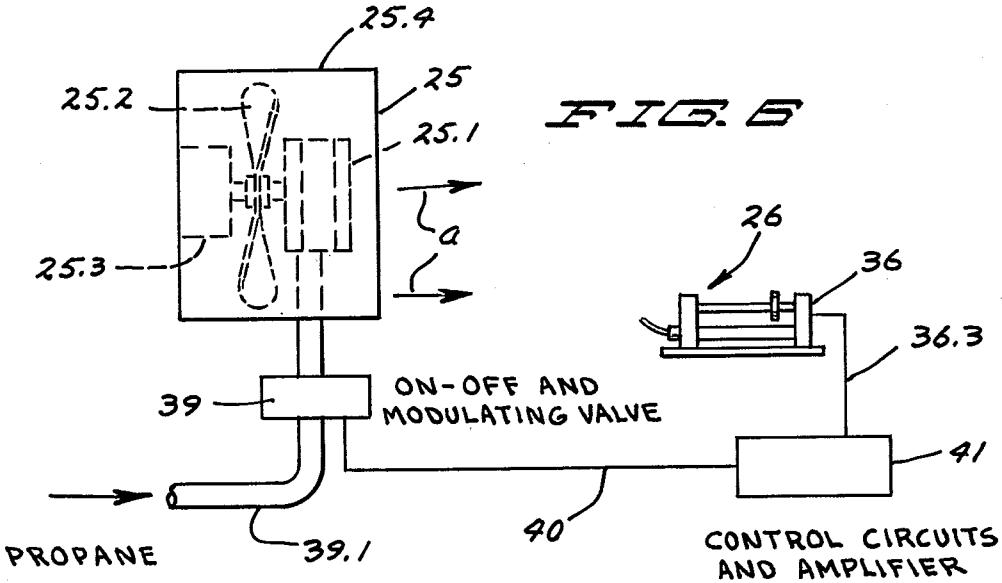
FIG. 6 is a diagrammatic sketch of the control apparatus utilized in the dryer of FIG. 1.

FIG. 6 indicates, diagrammatically, the control of the burner unit 25 of a particular stage in the dryer by the associated control unit 26. The burner unit 25 has a propane burner 25.1 and a fan 25.2. The fan is operated by an electric motor 25.3 so as to propel air through the housing 25.4 of the burner unit in the direction of arrows a which correspond to the air movement indicated by the same arrows a in the dryer in FIG. 1.

Propane gas to the burner 25.1 is controlled by a valve 39 which is preferably an on/off valve and also accomplishes a modulating function to vary the quantity of propane gas permitted to reach the burner 25.1 from the source 39.1. The valve 39 is connected by control circuitry 40 to a control circuit and amplifier 41 which senses the indications provided by switch 36 which are transmitted to the control circuits and amplifier by conductors 36.3.

In operation, each of the burner units 25 supplies heated air under pressure, as a result of the influence of fan 25.2 into the several plenums 14.1, 15.1 and 16.1 of the dryer. The quantity of heat supplied by the several burner units associated with these several plenums is varied, and the difference in the heat supplied is controlled by the adjustment of the rod 29 in the respective control unit 26. Although the dry bulb temperatures of the air in the several plenums will be different, all of the wet bulb temperatures in the several plenums will be identical, and will be the same as the wet bulb temperature of the ambient air being delivered into the plenums by the fan. The adjustment of the rods 29 in the threaded apertures of mounting block 27 of the several control units will vary the differential between the sensed wet bulb temperature and the dry bulb temperature measured in the plenum.

It is desired to have the lowest differential between wet bulb temperature and dry bulb temperature in the uppermost plenum 14.1, and higher differentials in the other plenums. Accordingly, the initial adjustment of rod 29 relative to control element 36.1 will be such that only a minimum of spacing exists between the end 29.2 of the rod and the control element 36.1. Accordingly, upon a minimal temperature-induced lengthening of rod 29, the switch 36 will be operated to modulate the heat downwardly supplied by burner 25.1.

Adjustment of the other control units 26 such that the operating end 29.2 of the dry bulb temperature-sensing rod slightly further away from the control unit 36.1 will cause a greater differential between the sensed wet bulb temperature and the induced dry bulb temperature in order to produce the desired drying effect.

Figure 2:
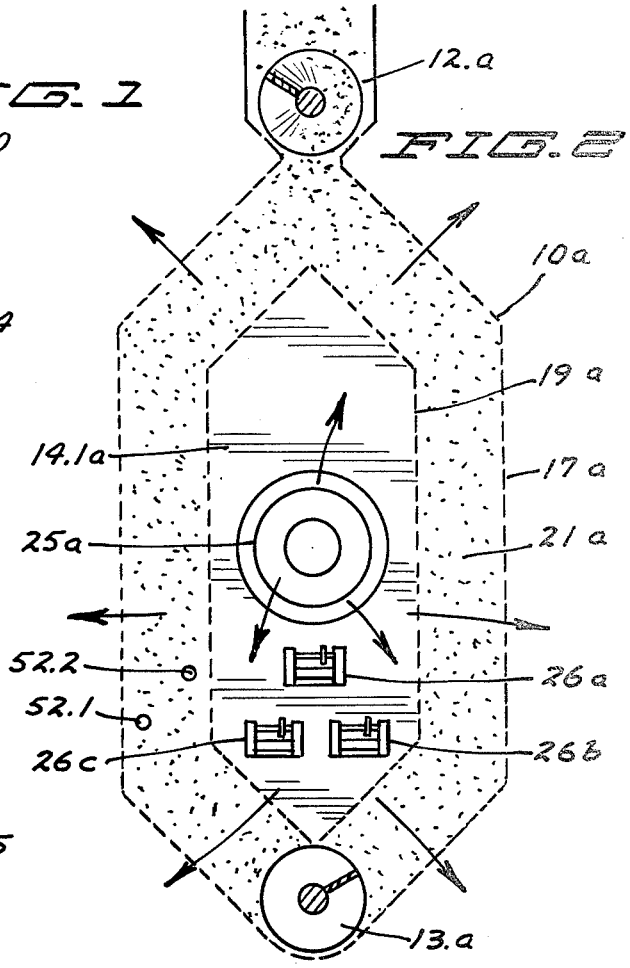
FIG. 2 is a somewhat diagrammatic section view taken through a modified form of dryer incorporating the present invention.
Figure 2A:
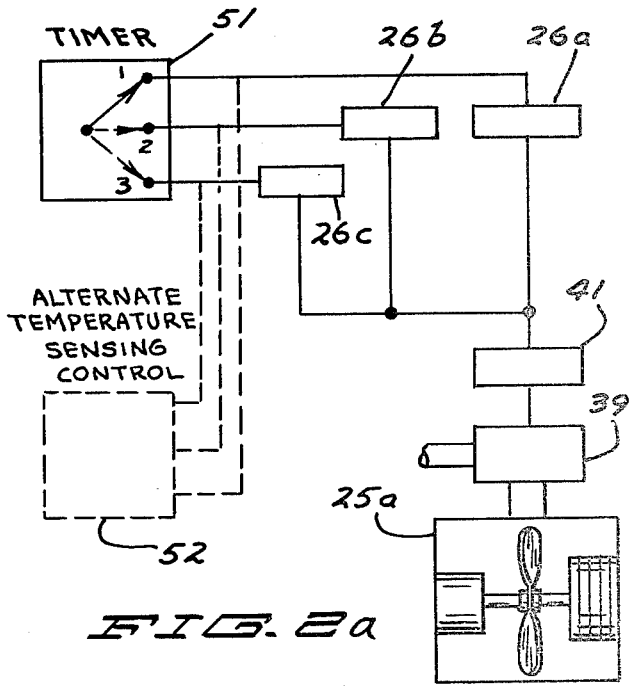
FIG. 2*a* is a schematic sketch of a modified form of control circuit.

In FIG. 2, a dryer **10*a* is illustrated wherein, between the perforate inner and outer walls 17*a* and 19*a*, a columnar space 21*a* is defined to confine a stationary column of rice to be dried. The dryer has suitable supply and discharging means, and auger conveyors 12*a* and 13*a* may be provided for this purpose. The burner 25*a* may be operated at different heats to change the temperature in the confined central plenum 14.1*a* for applying the desired temperature of air to the rice columns for drying. Several of the control units 26 illustrated in FIGS. 4 and 5 are provided in the dryer 10*a* and are indicated by numerals 26*a*, 26*b* and 26*c*. Each of the control units 26*a*, 26*b* and 26*c* is adjusted to a particular differential between dry bulb temperature and wet bulb temperature. The several control units may be alternately switched into and out of the control circuit by a timer or other suitable control device, but in FIG. 2*a*, a timer 51 is illustrated. Initially, control unit 26*a* will operate the burner 25*a* through the modulating on/off valve 39 and the control circuits and amplifier 41. After a suitable length of time during which the rate of drying in the grain column will be reduced, the timer 51 removes the control unit 26*a* from the control circuit and substitutes 26*b* which then increases the amount of heat supplied by burner 25*a*** and causes a temperature rise in the plenum so as to increase the differential between wet bulb and dry bulb temperature. This again increases the rate of drying in the rice column.

After another length of time, the timer 51 will switch the control unit **26*c* into controlling relation with the burner so as to again increase the differential between wet bulb and dry bulb temperature in the plenum by increasing the heat output from burner 25*a***.

In certain situations, it may be desirable to limit the operation of the timer so that the burner is only controlled by one of the control units such as **26*a***, whereupon, during the entire drying cycle, a uniform differential between wet bulb and dry bulb temperatures will be maintained.

In other instances, it may be desirable to substitute for the timer 51, a temperature-sensing device 52 responding to temperature conditions as sensed by thermo couples 52.1 and 52.2 in the columnar space **21*a* for the purpose of inducing a change of differential to be created by the burner 25*a* between wet bulb temperature and dry bulb temperature. Again, the several control units 26*a*, 26*b* and 26*c* wlll be switched into and out of the control circuit, depending upon the temperature conditions sensed in the columnar space. The temperature conditions in the rice are an indication of the moisture content and as the temperatures change, the state of dryness or moisture content can be estimated. In response to such moisture conditions, the burner 25*a* will be adjusted by modulating the valve 39** to create different heat conditions.

Figure 3:
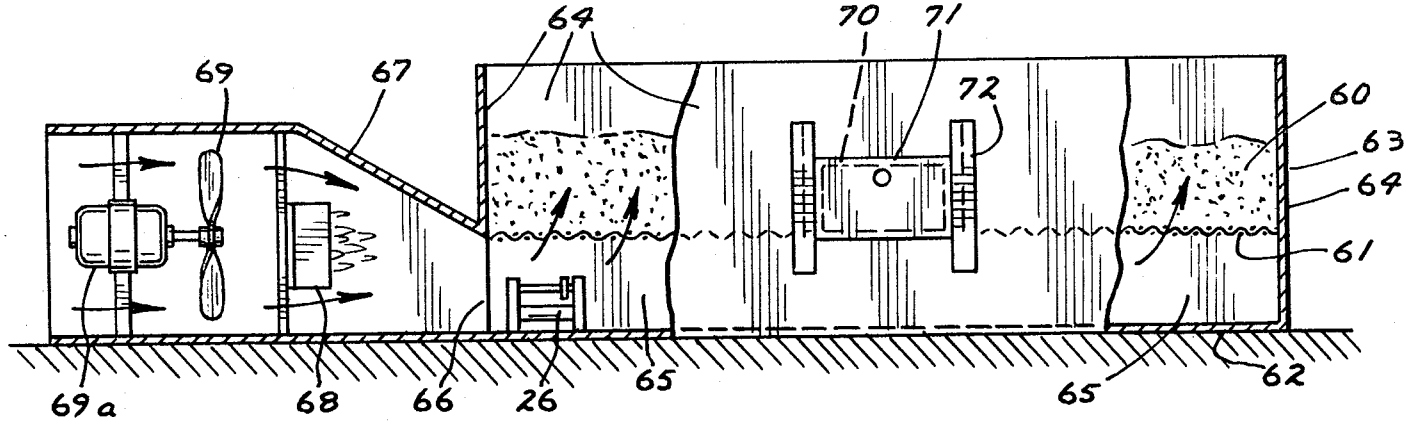
FIG. 3 is an elevation view, partly in longitudinal section, illustrating another form of dryer incorporating the present invention.

In FIG. 3, another form of dryer is illustrated wherein, in this instance, a bed 60 of rice lies on a horizontally oriented perforate plate or screen 61 spaced upwardly from the bottom 62 of an open-topped box-like enclosure 63 which has four upright sidewalls 64 confining the bed 60 of rice on the perforate plate 60 and also confining the space 65 beneath the perforate plate to define a plenum chamber. Air is supplied into the plenum chamber 65 through an opening 66 in one of the sidewalls and from an air duct 67 in which a burner 68 and a fan 69 are confined. The burner 68 is a propane burner as described hereinbefore which may be modulated by varying the supply of gas thereto so as to vary the heat supplied to the air being moved as indicated by the arrows into and through the bed of rice. The fan 69 is shown to be driven by an electric motor 69*a*, but of course, the electric motor may be replaced by a gasoline engine or other prime mover.

It may be desirable to have a discharge opening 70 in one of the sidewalls 64 which can be opened and closed by a slide gate 71 operating in tracks 72 to facilitate unloading the rice.

Again, one or more control units 26 is located in the plenum 65 as to sense the wet bulb temperature of the air and also the dry bulb temperature of the air, and cause the burner to operate as to create a predetermined differential between wet bulb and dry bulb temperatures in the air being supplied to and through the bed of rice. Of course, as indicated previously, more than one control unit 26 may be utilized so that temperature conditions may be changed to adjust the differential between wet bulb and dry bulb temperatures. Although this form illustrated in FIG. 3 may require considerable hand labor in handling the rice in the bed, this form can be extremely useful and will be simple to operate.

The container 63 may be as small as three feet square, or may be ten feet square, or larger, depending upon the size of burner and fan available. Of course, the bed of rice 60 must have a thickness comparable to the thickness of the columns of rice in the other forms of the invention disclosed. Typically, such columns may be 12 to 24 inches thick.

Although, in the forms of the invention illustrated herein, the control unit is confined in the stream of hot air between the burner and the column or bed of rice, it may, in some instances, be more practical to measure the wet bulb temperature of the air at ambient temperature or at the exterior of the dryer and before heat is supplied to the air. Such a technique is perfectly satisfactory, and is in accordance with the invention except that a slightly different form of sensing apparatus must be utilized in order to determine and maintain the differential between wet bulb and dry bulb temperatures.

Figure 8:
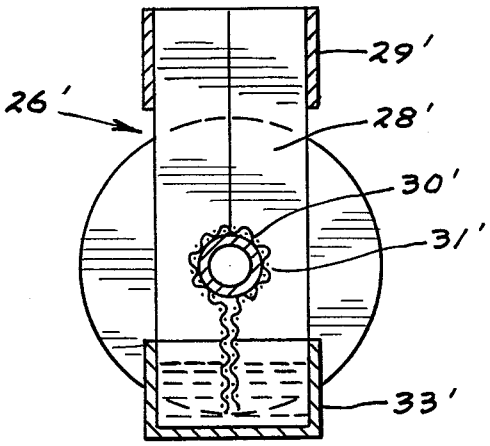
FIG. 8 is a detail transverse section taken approximately at 8—8 in FIG. 7.
Figure 7:
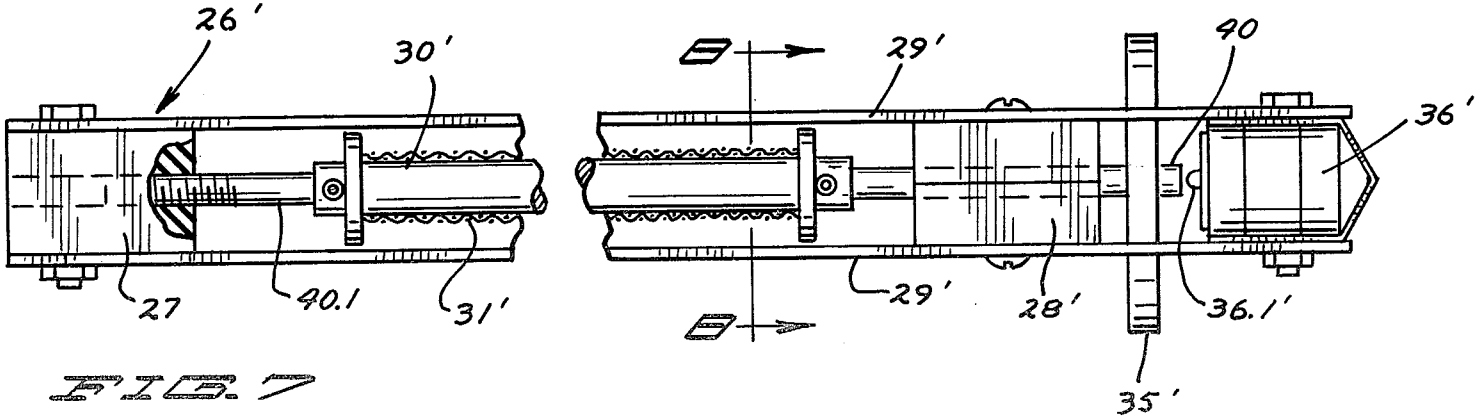
FIG. 7 is a top plan view of a modified form of temperature-sensing control unit.

In FIGS. 7 and 8, a modified form of control unit 26' is illustrated.

In this form, mounting blocks 27' and 28' are affixed to aluminum bars or rods 29' which lengthen and shorten under the influence of dry bulb temperature of the air adjoining the unit 26'. The ends of the bar-shaped rods 29' also mount the microswitch 36', the control element of which confronts the end of a rotatable rod 40 journaled in the bearing block 28' and attached by mounting pins to an aluminum tube 30' which is embraced by a wetted wick 31'. It will be recognized that the mounting rod 40 is discontinuous and has a threaded end 40.1 in a tapped aperture in mounting block 27' so as to vary the spacing between the end of rod 40 and the control element 36.1' of the microswitch. The rod 40 is freely slidable in the block 28 as the aluminum rod 30' extends and contracts under influence of sensed wet bulb temperature. The control wheel or disc 35' is affixed on the mounting rod 40 for turning the rod in the tapped aperture of mounting block 27'. Of course, the wick 31' is continually wetted by water contained in the container 33' beneath the unit.

Again, in the form of the control unit 26', as the rod 30' continually senses the wet bulb temperature of the surrounding air, the rods or bars 29' also sense the dry bulb temperature of the air and vary the location of the switch relative to the end of rod 40. The condition of the switch contacts in switch 36' changes in response to sensed dry bulb temperature variations so as to produce an indication which may be sensed by the control unit which will be associated therewith.

According to the present invention, the method by which the rice is dried includes the continuous application of heat to the rice during the single pass of the rice through the drying machine 10. In setting the dry bulb temperature, reference is made in all temperature conditions to the dry bulb temperature of the ambient air which wet bulb temperature is the same regardless of whether the air is at ambient temperature or heated in the plenums of the dryer. With the wet bulb temperature of the drying air as a base, the desired dry bulb temperature, and the related differential between wet bulb temperature and dry bulb temperature, is established by adding the appropriate quantity of heat to the air being used for the drying. In the first stage of drying at the upper stage 14 of the dryer, a differential between wet bulb and dry bulb temperatures is established so as to exceed the differential required to maintain the moisture content of the grain of the rice as the rice enters the dryer from hopper 11. During this first stage, moisture may be removed from the rice at a suitable rate to avoid fracturing and fissuring of the kernels. With certain types of rice and experienced wet bulb temperatures, it has been found successful in some cases to remove as much as $2\frac{1}{2}$ to 3 points of moisture per hour.

As the rice moves downwardly in the columnar spaces 21 and 22 adjacent the first stage 14 of drying, a temperature front passes through the column of rice to indicate the removal of moisture from the rice.

As the rice enters the columnar spaces 21 and 22 at the second stage 15 of the dryer, a higher differential between wet bulb and dry bulb temperature is encountered, and accordingly, the dry bulb temperature in the plenum 15.1 is somewhat higher than in the plenum 14.1. As a result, additional moisture is removed from the rice at the second stage of drying. Again, in the second stage 15 of the dryer, the wet bulb temperature of the air is used for a base of reference by the control unit 26 and the dry bulb temperature is sensed and controlled by operation of the respective burner unit 25. In a similar way, additional moisture is removed at the third stage 16 of the dryer so that the final condition of the rice as it emerges from the bottom of the dryer to conveyor 13 will be such as to permit storage of the rice in bins or elevators. In most cases, it is desired that the rice be at approximately 14 percent moisture for successful storage without spoilage.

Figure 9:
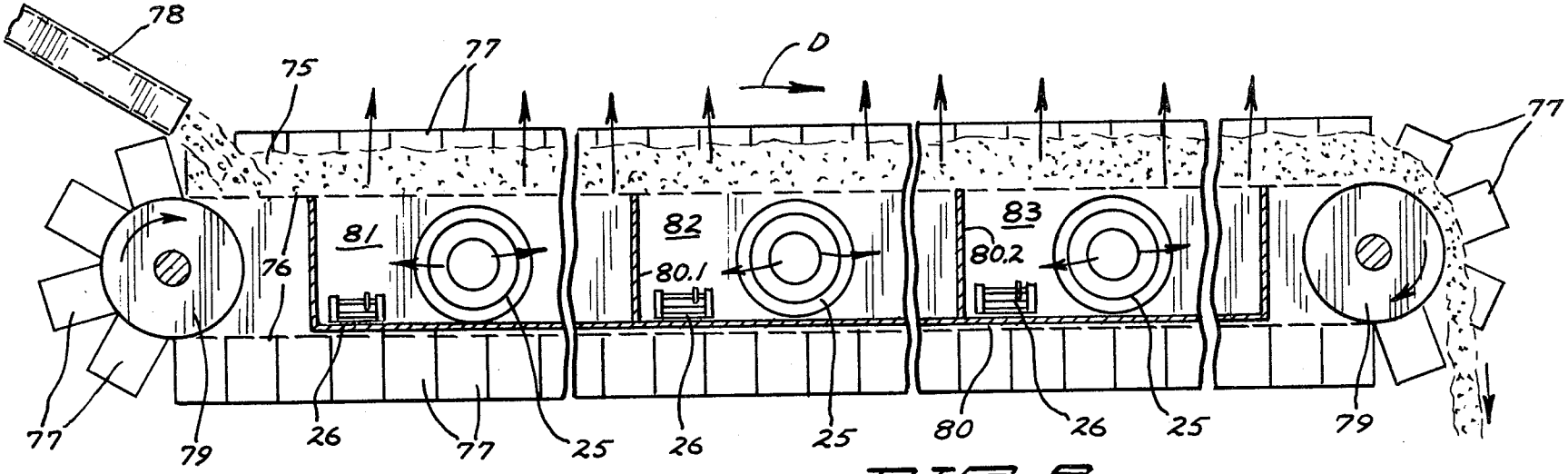
FIG. 9 is a diagrammatic longitudinal section view through another modified form of the invention.

In FIG. 9, a modified form of apparatus accomplishes drying using the same drying technique previously described, except in this modification, the granular material 75 is laid in a substantially horizontal bed carried on a perforate belt conveyor 76 which is provided with a segmented sidewall 77 to confine the bed of granular material on the perforate conveyor. The granular material is supplied onto the conveyor from a suitable source such as chute 78. The belt conveyor is trained about pulleys or rotors 79, and the downstream rotor 79 is driven by a motor at a slow rate of speed to substantially continuously move the perforate conveyor for conveying the bed of granular material in the direction of arrow d.

A housing 80 beneath the upper run of the perforate belt conveyor 76 has a number of partition walls 80.1 and 80.2 to define three separate plenums 81, 82 and 83. These open-topped plenums are supplied with heated air under pressure by a plurality of combined burner and fan units 25 as in FIG. 1. The heated air is moved upwardly through the perforate belt conveyor 76 and through the bed of granular material 75 on the belt conveyor to accomplish drying.

The temperature of the air in the separate plenums is controlled by a plurality of temperature control units 26 as previously described. In plenum 81, a first differential between dry bulb and wet bulb temperature is established and maintained by the respective temperature control 26 to establish a first rate of drying in the bed of granular material 75 moving over the plenum 81. The differential between dry bulb and wet bulb temperature in plenum 82 is larger than in plenum 81 so as to again increase the rate of drying of the granular material as the bed passes over plenum 82; and then in plenum 83, the differential between dry bulb and wet bulb temperatures is again increased to again increase the rate of drying and complete the drying of the granular material.

Figure 10:
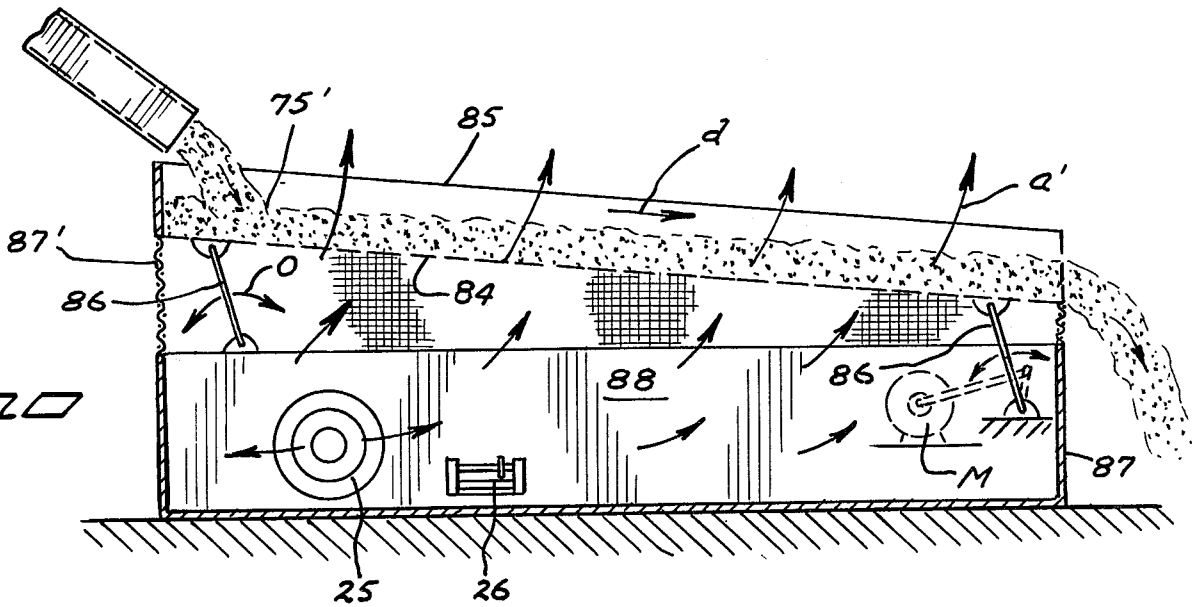
FIG. 10 is a somewhat diagrammatic longitudinal section through another modified form of the invention.

In FIG. 10, the granular material 75' is laid in a bed on a perforate shaker table 84 which may be a screen. The shaker table has a confining peripheral sidewall 85 to provide a frame for the perforate table 84. The perforate table 84 may be a screen or apertured sheet metal, not unlike the perforate sidewalls as illustrated in FIGS. 1 and 2. The shaker table is mounted on links 86 so as to oscillate in the direction of arrows o, causing the granular material to move along the perforate shaker table in the direction of arrow p. The driving force may be provided by a motor m.

A housing 87 provides a plenum chamber 88 into which heated air is supplied under pressure by a combined blower and burner 25.

A control unit 26 establishes a predetermined differential between dry bulb and wet bulb temperature in the plenum 88 to produce a predetermined drying rate of the granular material 75' moving along the shaker bed. The housing 87 is connected to the shaker table by a flexible fabric extension 87' which permits oscillation of the shaker table, but confines the air in the plenum 88 so as to pass all of the air outward through the bed of granular material as indicated by the arrows a'.

It will be seen that I have provided a new and improved method of drying rice by a continuous process, using the wet bulb temperature of the drying air as a reference point or base and establishing the necessary dry bulb temperature bulb temperature of the air by adding heat in order to maintain a predetermined differential between wet bulb and dry bulb temperature to finally arrive at the moisture condition necessary for successful storage or further processing. It has been found that drying in this way can be accomplished by the farmer on the farm and that substantial storage facilities are not required as have been required by the multipass methods used in the past. It will further be seen that I have provided suitable apparatus and controls for accomplishing the method set forth. It should be recognized that the method may be carried out by periodically measuring the wet bulb temperature manually and then manually setting the heat required to maintain the desired differential between wet bulb and dry bulb temperatures in the drying air. While flow of the rice through several stages of drying is desirable, the same technique can be used by static columns of rice and by simply varying the temperature over a period of time of the air which is applied to the rice column.

What is claimed is:

1. A method drying rice or the like to be suitable for storing or further processing, comprising, confining a quantity of the rice in a chamber through which air may be passed, heating and pressurizing air at one side of the chamber and causing the heated air to once pass through the entire quantity of confined rice in the chamber, and sensing the wet bulb temperature of the air prior to passing the air through the chamber, and sensing the dry bulb temperature of the air prior to passing the air through the chamber and comparing the dry bulb temperature of the air with the wet bulb temperature of the air, and regulating the heating of the air to maintain a predetermined differential between the dry bulb and wet bulb temperatures of the air.

2. The drying method according to claim 1 and the differential having a magnitude significantly in excess of the differential required to maintain an equilibrium moisture condition.

3. The drying method according to claim 1 and progressively increasing the differential between wet bulb and dry bulb temperatures of the air as drying of the rice continues to remove additional quantities of moisture from the material.

4. The drying method according to claim 1 wherein the rice is confined in stationary condition in the chamber during drying.

5. The drying method according to claim 3 wherein the rice is confined in stationary condition in the chamber during drying.

6. The drying method according to claim 1 and progressively moving the rice through the chamber during the drying thereof.

7. The drying method according to claim 3 and progressively moving the rice through the chamber during the drying thereof.

8. The drying method according to claim 7 wherein, as the rice is progressively moved through the chamber, drying air of progressively increased temperatures is passed through the rice.

9. The drying method according to claim 4 wherein the differential between dry bulb and wet bulb temperatures is progressively increased as drying is continued.

10. The drying method according to claim 4 wherein the rice is confined in an upright column of finite thickness, and the air is directed generally horizontally through the upright column of rice.

11. The drying method according to claim 4 wherein the rice is disposed in a substantially horizontal bed of finite thickness and the air is caused to pass through the bed in a direction substantially transversely of the horizontal bed.

12. The drying method according to claim 6 wherein the rice is confined in an upright column of finite thickness in the chamber and the air is directed generally horizontally through the upright column of rice.

13. The drying method according to claim 6 wherein the rice is disposed in a substantially horizontal bed of finite thickness within the chamber and the air is caused to pass through the bed in a direction substantially transversely of the horizontal bed.

14. The drying method according to claim 12 wherein the rice is moved downwardly in the column through the chamber under influence of gravity.

15. The drying method according to claim 13 wherein the rice is carried substantially horizontally in a layer in the chamber.

16. A method of drying rice to be suitable for storing or further processing, comprising confining a quantity of rice in a chamber through which air may be passed, heating and pressurizing air at one side of the chamber and causing the heated air to pass through the quantity of confined rice in the chamber, sensing the wet bulb temperature of the air prior to passing the air through the rice, and sensing the dry bulb temperature of the air prior to passing the air through the rice and comparing the dry bulb temperature of the air with the wet bulb temperature of the air, and regulating the heating of the air to maintain a predetermined differential between dry bulb and wet bulb temperatures of the air.

17. The drying method according to claim 9 and the differential having a magnitude significantly in excess of the differential required to maintain an equilibrium moisture condition in the rice, which moisture condition is suitable to permit storing of the rice without spoilage.

18. The drying method according to claim 1 and including drawing the air for heating and pressurizing from the adjacent ambient atmospheric conditions.

19. The drying method according to claim 18 and including returning the air which has been caused to pass through the quantity of confined material in the chamber, into the adjacent ambient atmosphere.

* * * * *